US009583842B2

(12) United States Patent
Ganchrow et al.

(10) Patent No.: US 9,583,842 B2
(45) Date of Patent: Feb. 28, 2017

(54) SYSTEM AND METHOD FOR ATTACHING SOLDER BALLS AND POSTS IN ANTENNA AREAS

(71) Applicant: QUALCOMM Incorporated, San Diego, CA (US)

(72) Inventors: Elimelech Ganchrow, Haifa (IL); Alon Yehezkely, Haifa (IL)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/754,823

(22) Filed: Jun. 30, 2015

(65) Prior Publication Data

US 2016/0006133 A1 Jan. 7, 2016

Related U.S. Application Data

(60) Provisional application No. 62/019,665, filed on Jul. 1, 2014.

(51) Int. Cl.

| | |
|---|---|
| ***H01Q 21/00*** | (2006.01) |
| ***H01Q 21/28*** | (2006.01) |
| ***H01Q 1/24*** | (2006.01) |
| ***H01Q 1/22*** | (2006.01) |
| ***H01Q 21/06*** | (2006.01) |
| *H01Q 1/38* | (2006.01) |
| *H01Q 23/00* | (2006.01) |

(52) U.S. Cl.

CPC ..... *H01Q 21/28* (2013.01); *H01Q 1/2283* (2013.01); *H01Q 1/24* (2013.01); *H01Q 21/0087* (2013.01); *H01Q 21/062* (2013.01); *H01Q 21/067* (2013.01); *H01Q 1/38* (2013.01); *H01Q 23/00* (2013.01)

(58) Field of Classification Search

CPC .. H01C 21/28; H01C 21/0087; H01C 21/067; H01C 1/24; H01C 21/062; H01C 1/2283; H01C 23/00; H01C 1/38

USPC ..... 343/879

See application file for complete search history.

(56) References Cited

U.S. PATENT DOCUMENTS

| | | | |
|---|---|---|---|
| 6,998,710 B2 | 2/2006 | Kobayashi et al. | |
| 8,451,618 B2 * | 5/2013 | Boeck | H01L 23/49816 361/761 |
| 8,718,550 B2 | 5/2014 | Zhao et al. | |
| 8,854,277 B2 | 10/2014 | De Graaw et al. | |
| 2009/0160717 A1 | 6/2009 | Tsutsumi et al. | |
| 2012/0193810 A1 | 8/2012 | Tsutsumi et al. | |
| 2013/0016015 A1 | 1/2013 | Tsutsumi | |
| 2013/0222196 A1 | 8/2013 | Hashimoto et al. | |
| 2014/0158774 A1 | 6/2014 | Tsutsumi et al. | |

OTHER PUBLICATIONS

International Search Report and Written Opinion—PCT/U52015/038743—ISA/EPO—Oct. 6, 2015.

* cited by examiner

*Primary Examiner* — Khai M Nguyen

(57) ABSTRACT

Aspects of the present disclosure provide an apparatus for wireless communications. The apparatus generally includes a printed circuit board (PCB) and a plurality of antenna elements. Each of the plurality of antenna elements is mechanically attached to a perimeter of the PCB via one or more solder elements. Each of the solder elements are spaced apart from each other and electrically isolated from each other in a vicinity of the antenna elements.

24 Claims, 4 Drawing Sheets

SYSTEM AND METHOD FOR ATTACHING SOLDER BALLS AND POSTS IN ANTENNA AREAS

CROSS-REFERENCE TO RELATED APPLICATION(S)

This application claims benefit of U.S. Provisional Patent Application Ser. No. 62/019,665, entitled "System and Method for Attaching Solder Balls and Posts in Antenna Areas," filed Jul. 1, 2014, and assigned to the assignee hereof, the contents of which are herein incorporated by reference.

TECHNICAL FIELD

Aspects of the present disclosure generally relate to radio frequency (RF) systems, and more particularly to attaching antenna modules of an RF system to a printed circuit board (PCB) via solder elements.

BACKGROUND

In attempts to make 60 GHz radio systems more compact, manufacturers attempt to minimize distances between components of such radio systems while maintaining performance Radio modules often have antennas around their edges, and placing grounded solder balls or posts can negatively affect the antenna performance. Most antennas require that any extraneous metal structures be several wavelengths from the antenna's radiating structure to work most efficiently. Excess metal can ground out the antenna, thereby reducing the impedance match and ruining the antenna's efficiency.

The mechanical/electrical connection between the module and main board can be built from structures such as solder balls or posts, metal pads, other electromechanical structures, or solder paste. All of these connectors are metallic. A metallic ground that provides both thermal and mechanical connectivity to all the solderable elements is an ideal solution. However, this large ground plane in the area of the antennas is damaging to the antenna performance.

It would therefore be desirable to provide a solution to problems in the existing art by permitting attachment of metallic grounding components of an antenna radio system without decreasing antenna performance.

SUMMARY

The systems, methods, and devices of the present disclosure each have several aspects, no single one of which is solely responsible for its desirable attributes. Without limiting the scope of this disclosure as expressed by the claims, which follow, some features will now be discussed briefly. After considering this discussion, and particularly after reading the section entitled "Detailed Description," one will understand how the features of this disclosure provide advantages that include antenna diversity for wireless devices.

Certain aspects of the present disclosure provide an apparatus for wireless communications. The apparatus generally includes a printed circuit board (PCB) and a plurality of antenna elements. Each of the plurality of antenna elements is mechanically attached to a perimeter of the PCB via one or more solder elements. Each of the solder elements are spaced apart from each other and electrically isolated from each other in a vicinity of the antenna elements.

Certain aspects of the present disclosure provide a method for coupling a printed circuit board (PCB) and a plurality of antenna elements using one or more solder elements. The method generally includes positioning a plurality of antenna elements relative to a PCB, and attaching the antenna elements to the PCB using one or more solder elements. Each of the solder elements are spaced apart and electrically isolated from each other in a vicinity of the antenna elements.

Certain aspects of the present disclosure provide a wireless node. The wireless node generally includes a transceiver, a printed circuit board (PCB) and a plurality of antenna elements. Each of the plurality of antenna elements is coupled to the transceiver and mechanically attached to a perimeter of the PCB via one or more solder elements. Each of the solder elements are spaced apart from each other and electrically isolated from each other in a vicinity of the antenna elements.

Certain aspects of the present disclosure provide an apparatus for wireless communications. The apparatus generally includes means for transmitting and receiving radio frequency signals and means for coupling the means for transmitting and receiving radio frequency signals to a printed circuit board (PCB). The means for coupling are spaced apart and electrically isolated from each other in a vicinity of the means for transmitting and receiving radio frequency signals.

BRIEF DESCRIPTION OF THE DRAWINGS

The foregoing and other objects, features, and advantages of the present disclosure will be apparent from the following detailed description taken in conjunction with the accompanying drawings.

DETAILED DESCRIPTION

Figure 1:
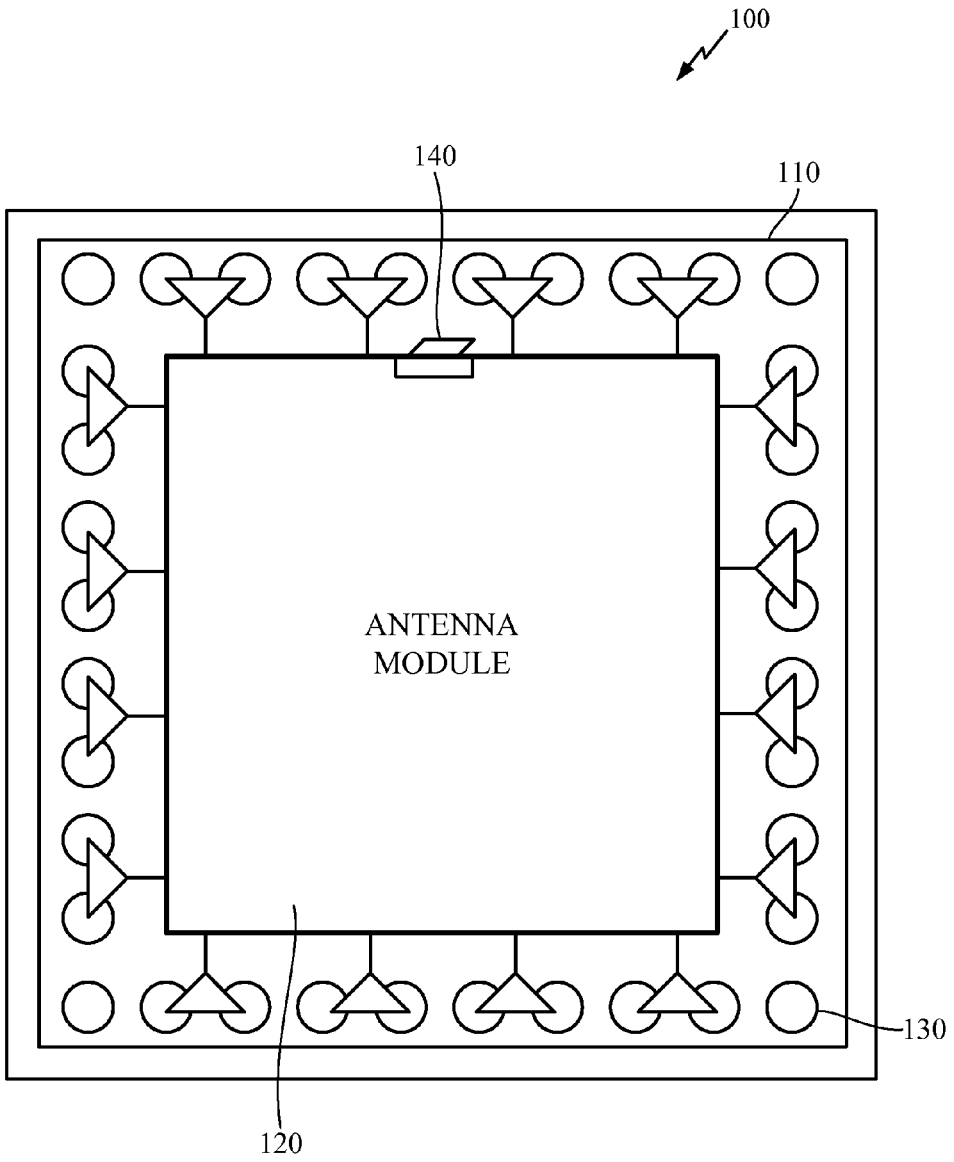
FIG. 1 illustrates an example device in which an antenna module is packaged, in accordance with certain aspects of the present disclosure.

The aspects disclosed herein are only examples of the many possible advantageous uses and implementations of the innovative teachings presented herein. In general, statements made in the specification of the present application do not necessarily limit any of the various claimed aspects of the present disclosure. Moreover, some statements may apply to some inventive features but not to others. In general, unless otherwise indicated, singular elements may be in plural and vice versa with no loss of generality. In the drawings, like numerals refer to like parts through several views.

In a wireless device, solder elements can be used to electrically and/or mechanically couple an antenna package to a base printed circuit board (PCB). If an antenna element is coupled to a base PCB using solder elements that are attached to each other in the vicinity of the antenna element, the solder elements may create a significant loading effect on the antenna element. While antenna elements can be returned to compensate for a minor loading effect, antenna retuning may not be able to compensate for more significant antenna loading effects. Antenna loading effects may additionally be influenced by the size of a solder element. As bandwidth increases, and correspondingly, as the wavelength of a radio wave decreases, the loading effect for a given solder element diameter increases.

As wireless devices become smaller, less room is available on a single layer PCB for the necessary components of a wireless device. For example, a laptop computer may provide a relatively large area in which antenna elements, baseband chips, and other radio frequency equipment. In contrast, smaller devices, such as smartwatches, have a very small area in which a power source, processor, antenna elements, and radio frequency chips are to be packaged. To enable the packaging of an entire system into a small area, such as in a smartphone, smartwatch, tablet, or other small wireless devices, systems-in-package (SiPs) have been developed. By packaging large portions of a computer system into a package, multiple SiPs can be used to build an entire computer system in a relatively small amount of space.

Aspects of the present disclosure provide an apparatus in which a plurality of antenna elements are attached a PCB via a plurality of floating solder elements. By attaching antenna elements to a PCB using floating solder elements, a compact SiP usable in compact devices, such as smartwatches, smartphones, or tablets, may be formed with a minor loading effect on the antenna elements. Additionally, attaching antenna elements to a PCB using floating solder elements may allow for device designs in which solder elements are placed symmetrically and proximal to the edges of an antenna module.

FIG. 1 illustrates an example of a wireless device 100 in which an antenna radio system is packaged. Wireless device 100 may be a smartphone, tablet, smartwatch (or other wearable wireless device), laptop computer, or other device that communicates wirelessly (e.g., via Wi-Fi).

Wireless device 100 generally includes a printed circuit board (PCB) 110 with one or more processors and an antenna module 120. While not shown, device 100 may include a transceiver, which includes a baseband module and an RF module. When transmitting signals, the baseband module generally provides control signaling, power, and local oscillator and intermediate frequency signals to an RF module. The control signaling may be used for functions such as gain control, receive/transmit switching, power level control, and detector readouts. For example, in beamforming RF systems, high frequency beam steering operations are performed under the control of the baseband module (i.e., based on the control signaling).

The RF module may be used to generate RF signals to be transmitted through antenna module 120 and process RF signals received via the antenna module. For transmission, the RF module generally upconverts a signal received from the baseband module and transmits the RF signal through one or more transmit (TX) antenna according to the control signaling. For reception, the RF module receives RF signals (e.g., at the 60 GHz frequency band) through one or more active receive (RX) antenna and performs a down-conversion of the received RF signals. The downconverted signal is sent to the baseband module.

Antenna module 120 may include a plurality of antenna elements, and antenna module 120 may be a package of a single unit of the plurality of antenna elements. As illustrated, the plurality of antenna elements may be disposed around a perimeter of the printed circuit board. In smaller devices, such as a smartwatch, the perimeter of the printed circuit board may substantially be the perimeter of the device, and the antenna elements included in antenna module 120 may thus be disposed substantially around a perimeter of the device. In some aspects, the plurality of antenna elements may form an array of antenna elements, and the antenna elements may be evenly spaced along a perimeter of PCB 110. Antenna module 120 may be configured to form a radiation pattern that radiates outwards from the perimeter of PCB 110.

Antenna module 120 may be mechanically and electrically connected to printed circuit board 110. A mechanical connection between antenna module 120 and printed circuit board 110 generally includes one or more solder elements 130 on which antenna module 120 is attached. Each of the solder elements 130 are floating elements that are spaced apart from each other and not connected to an electrical ground plane. Because solder elements 130 are floating elements, antenna module 120 may be soldered to PCB 110 without affecting antenna performance.

In some aspects, solder elements 130 may be solder balls or solder posts. In either case, solder elements 130 may have a diameter smaller than the wavelength of the bandwidth at which antenna module 120 performs wireless communications in order to minimize any loading effect (e.g., a grounding effect or impedance mismatch) the solder elements may have on antenna module 120. In some cases, the diameter of solder elements 130 may be substantially smaller than the wavelength at which antenna module 120 operates. For example, if antenna module 120 operates on the 60 GHz bandwidth (corresponding to a wavelength of 5 mm), each solder element may have a diameter of less than 0.5 mm (less than 1/10 of the wavelength) to minimize a loading effect on the antenna module. Any loading effect imparted on the antenna module may be rectified by retuning the antenna elements included in antenna module 120.

In some embodiments, the one or more solder elements 130 may form a frame around a perimeter of PCB 110. An antenna module 120 may be substantially the same size as PCB 110. By coupling an antenna module 120 and a PCB 110 having substantially the same size, a plurality of antenna elements may be disposed along a perimeter of PCB 110.

An electrical connection 140 between printed circuit board 110 and antenna module 120 may be, for example, a cable connecting PCB 110 and antenna module 120. The electrical connection 140 between PCB 110 and antenna module 120 provides a connection for antenna module 120 to receive power, control, and RF signals from a baseband module on PCB 110 and to transmit received RF signals to a baseband module on PCB 110 for further processing.

In some aspect, an antenna module may be mounted on a solder element frame. One or more solder elements 130 mounted on a base PCB 110 forms a solder element frame on which an antenna module 120 having a plurality of antenna elements can be mounted. Solder elements 130 may be floating solder elements that are not connected to each other and are not connected to an electrical ground plane (i.e., solder elements 130 may be mechanical structures that do not provide an electrical connection between an antenna module and a PCB). In some aspects, solder elements 130 may be disposed around a perimeter of PCB 110.

As illustrated, antenna module 120 is coupled to PCB 110 via the solder elements 130. In some aspects, antenna module 120 may be a second PCB having a plurality of antenna elements coupled around the perimeter of the second PCB and including a plurality of antenna controllers. Each of the antenna controllers included on antenna module 120 may control one or more antenna elements.

In some aspects, antenna module 120 may be coupled to PCB 110 by mounting one or more antenna elements on one or more solder elements 130. In an example, antenna elements may be dipole antenna elements having a first end and a second end. A first end of a dipole antenna element may be coupled to a first solder element 130, and second end of a dipole antenna element may be coupled to a second solder element 130. In some cases, additional solder elements 130 may be used to support an antenna element between the first and second ends.

In some aspects, antenna module 120 may be further coupled to PCB 110 by coupling a PCB component of antenna module 120 to PCB 110 via one or more solder elements 130. The solder elements 130 may be spaced apart and electrically isolated from each other in a vicinity of the antenna elements.

According to some embodiments, antenna module 120 need not include antenna elements on all sides of the antenna module. For example, antenna elements may be included three sides of a rectilinear antenna module, and no antenna elements may be present on the remaining side of the antenna module. Solder elements 130 thus couple the side of the PCB component of antenna module 120 without any antenna elements to PCB 110.

Figure 2:
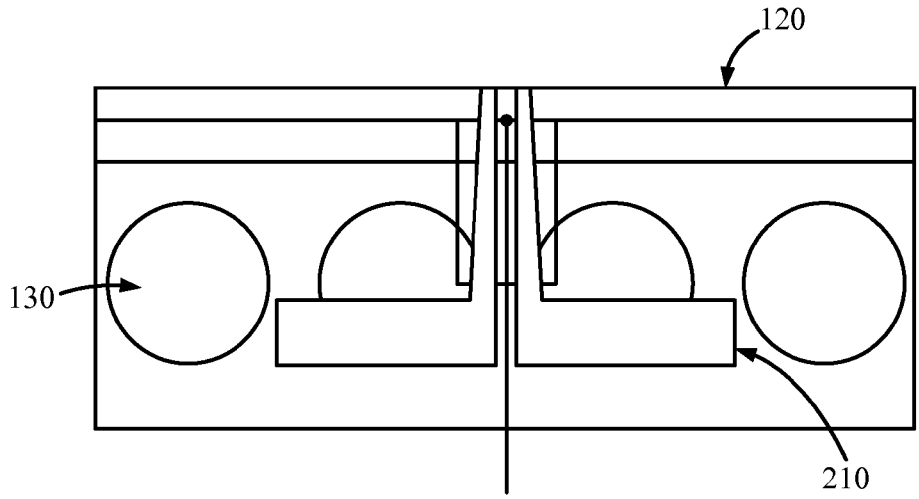
FIG. 2 illustrates a top view of an antenna element mounted on a solder element frame, in accordance with certain aspects of the present disclosure.

FIG. 2 illustrates a top view of an antenna element attached to one or more solder elements, according to an aspect of the present disclosure. As illustrated, an antenna element 210 of antenna module 120 is mounted on one or more solder elements 130. The one or more solder elements 130 may be positioned substantially along a perimeter of base PCB 110 and provide a mechanical connection between an antenna element 210 and base PCB 110. The one or more solder elements 130 may be solder balls or posts and may have a diameter less than the wavelength of the bandwidth at which antenna element 210 operates (e.g., if antenna element 210 operates in the 60 GHz bandwidth, which has a wavelength of 0.5 mm, the solder elements 130 may have a diameter of less than 0.5 mm).

Figure 3:
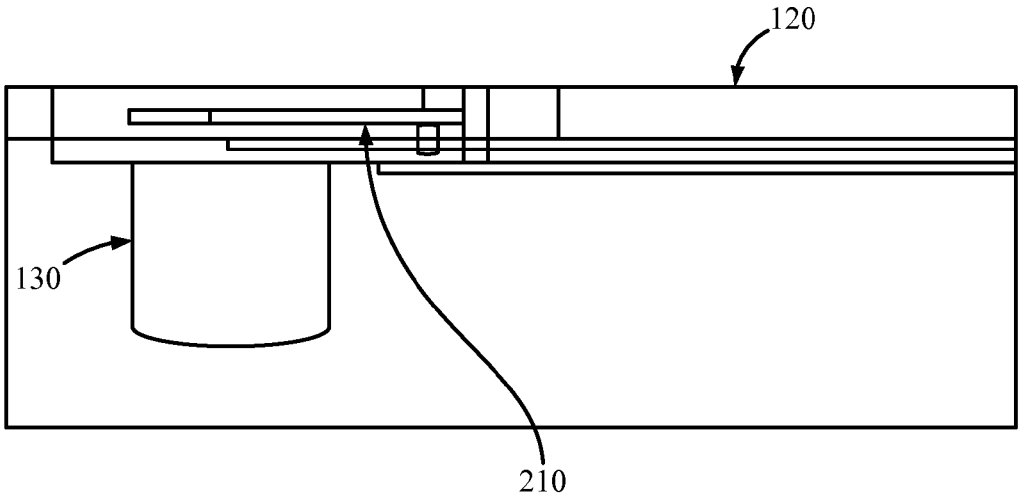
FIG. 3 illustrates a side view of an antenna element mounted on a solder element frame, in accordance with certain aspects of the present disclosure.

FIG. 3 illustrates a side view of an antenna element attached to a solder element 130, according to an aspect of the present disclosure. As illustrated, each individual solder element 130 is spaced apart and electrically isolated from each other, and each individual solder element 130 provides a mechanical connection between PCB 110 and antenna module 120. An antenna element 210 of antenna module 120 is coupled to solder element 130. In some cases, antenna element 210 may be electrically isolated from solder element 130. For example, a dielectric material may be interposed between antenna element 210 and solder element 130. By coupling an antenna element 210 to a solder element 130, an antenna module 120 may be mechanically mounted on top of a base PCB 110. Mounting an antenna module 120 to a PCB 110 via solder elements 130 may allow for production of a compact wireless communications package with minimal loading effects on the antenna elements from the solder elements 130.

Figure 4:
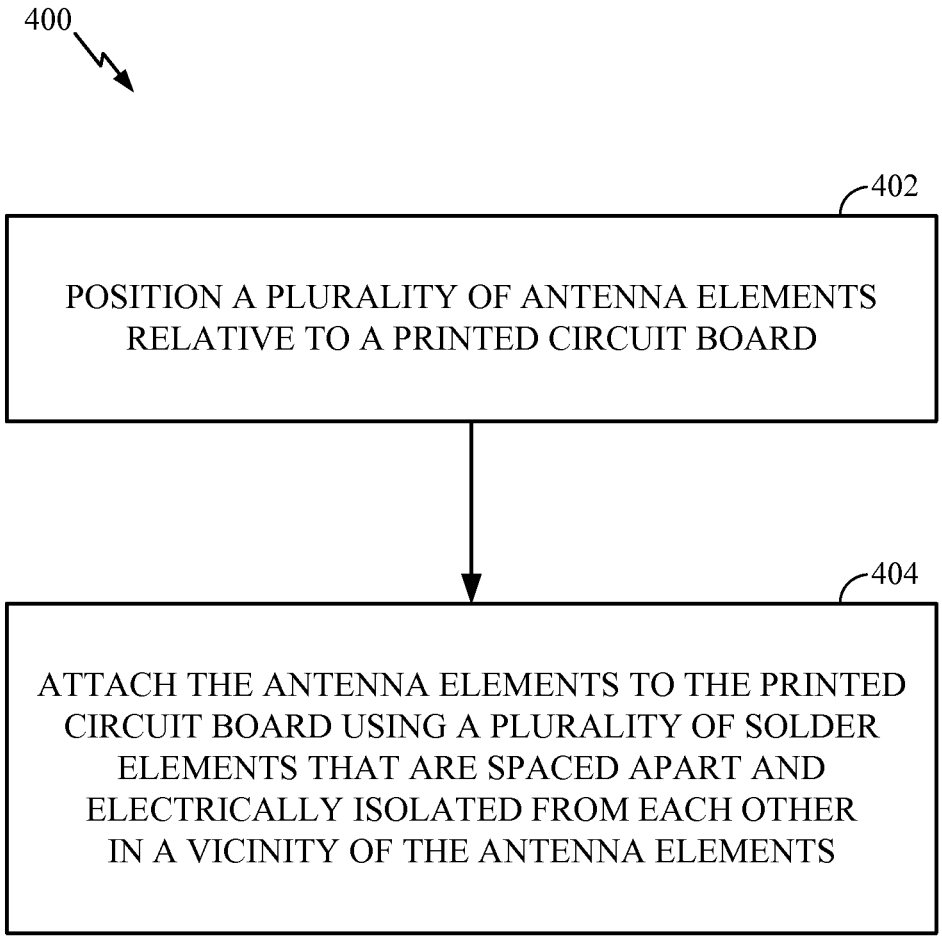
FIG. 4 is a flow diagram illustrating an example method for mounting an antenna module on a solder element frame, in accordance with certain aspects of the present disclosure.

FIG. 4 illustrates a flow diagram of an example method 400 for attaching a plurality of antenna elements to a printed circuit board using solder elements, according to an aspect of the present disclosure. Method 400 begins at 402, where a plurality of antenna elements are positioned relative to a printed circuit board. At 404, the plurality of antenna elements are attached to the printed circuit board using one or more solder elements. The solder elements are spaced apart and electrically isolated from each other in a vicinity of the antenna elements.

Figure 5:
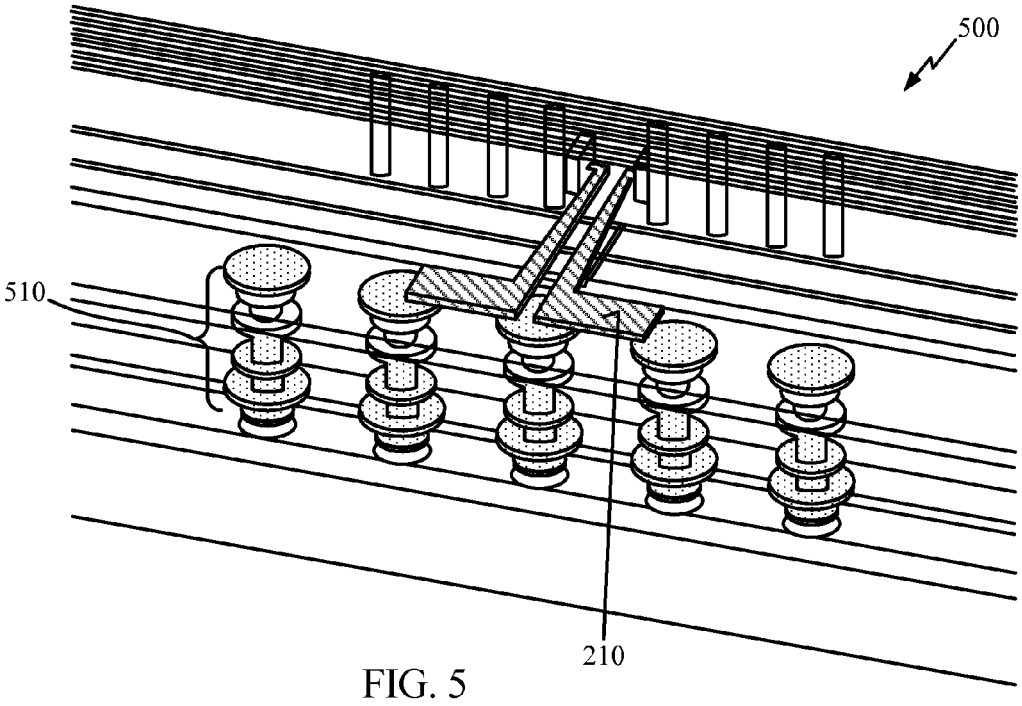
FIGS. 5-6 illustrate example structures that may be formed as a result of a mounting an antenna module on a solder element frame, in accordance with certain aspects of the present disclosure.

FIG. 5 illustrates an example structure 500 of a single antenna element attached to a solder ball frame that may result from attaching a plurality of antenna elements to a printed circuit board using solder elements, according to an aspect of the present disclosure (e.g., according to the operations 400 shown in FIG. 4).

Structure 500 is an expanded view of a single antenna attached to a PCB via one or more solder balls 510. As illustrated, antenna element 210 is attached to a PCB using multiple solder balls 510 that are not attached to each other and electrically isolated from each other in the vicinity of antenna element 210. A first end of antenna element 210 is supported by a first solder ball, and a second end of antenna element 210 is supported by a second solder ball. A central portion of antenna element 210 may be supported by yet another solder ball.

Figure 6:
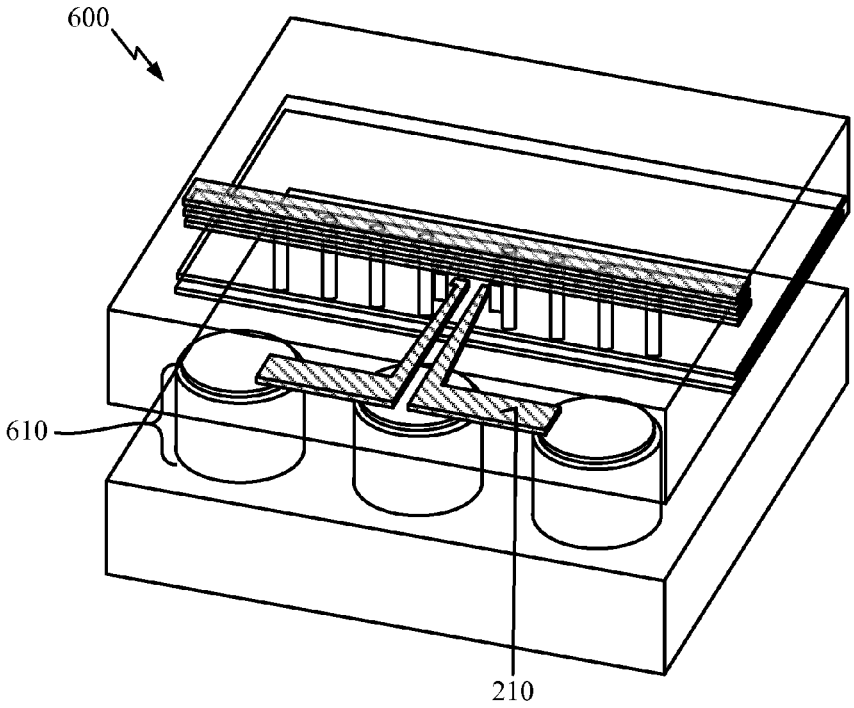

FIG. 6 illustrates an example structure 600 of a single antenna attached to a PCB via one or more solder balls, according to an aspect of the present disclosure (e.g., according to the operations 400 shown in FIG. 4). Solder balls 610 are not attached to each other, are electrically isolated from each other in the vicinity of antenna element 210, and may have a diameter of 500 μm (0.5 mm), which is 1/10 of the wavelength of a 60 GHz radio signal. As illustrated, antenna element 210 may be a dipole antenna element supported by solder balls 610 at a first end and a second end of the antenna element, and a central portion of antenna element 210 may be supported by another solder ball 610.

By attaching antenna modules to printed circuit boards using solder elements that are spaced apart and electrically isolated from each other in a vicinity of the antenna elements of an antenna module, a compact package with minimal impact on antenna performance may be formed. Forming compact antenna packages may be advantageous in building components for smaller wireless devices, such as smartphones, tablets, or smartwatches (or other wearable devices).

As used herein, a phrase referring to "at least one of" a list of items refers to any combination of those items, including single members. As an example, "at least one of: a, b, or c" is intended to cover: a, b, c, a-b, a-c, b-c, and a-b-c.

In one or more aspects, transmitting and receiving radio frequency signals may be performed by antenna elements 210 or any suitable means, including hardware, software, firmware, or any combination thereof. Similarly, means for coupling may include solder elements 130, solder balls 510, solder balls 610, or any suitable means.

The various illustrative logical blocks, modules (subsystems and sub-modules) and circuits described in connection with the present disclosure may be implemented or performed with a general purpose processor, a digital signal processor (DSP), an application specific integrated circuit (ASIC), a field programmable gate array (FPGA) or other programmable logic device (PLD), discrete gate or transistor logic, discrete hardware components, or any combination thereof designed to perform the functions described herein. A general-purpose processor may be a microprocessor, but in the alternative, the processor may be any commercially available processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer.

It is to be understood that the claims are not limited to the precise configuration and components illustrated above. Various modifications, changes and variations may be made in the arrangement, operation and details of the methods and apparatus described above without departing from the scope of the claims.

What is claimed is:

1. An apparatus for wireless communication, comprising:

a printed circuit board (PCB); and a plurality of antenna elements, each directly attached to a perimeter of the PCB via one or more solder elements, wherein the solder elements are spaced apart and electrically isolated from each other in a vicinity of the antenna elements.

2. The apparatus of claim 1, wherein the solder elements are electrically isolated from the antenna elements.

3. The apparatus of claim 1, wherein the one or more solder elements form a frame around the perimeter of the PCB.

4. The apparatus of claim 1, wherein the plurality of antenna elements are evenly spaced along the perimeter of the PCB.

5. The apparatus of claim 1, wherein the plurality of antenna elements are configured to form a radiation pattern that radiates outward from the perimeter of the PCB.

6. The apparatus of claim 1, wherein the plurality of antenna elements comprises a plurality of antenna elements packaged in a single unit.

7. A method, comprising:

positioning a plurality of antenna elements relative to a printed circuit board (PCB); and directly attaching the antenna elements to the PCB using one or more solder elements, wherein the solder elements are spaced apart and electrically isolated from each other in a vicinity of the antenna elements.

8. The method of claim 7, wherein the solder elements are electrically isolated from the antenna elements.

9. The method of claim 7, wherein the one or more solder elements form a frame around the perimeter of the PCB.

10. The method of claim 7, wherein the plurality of antenna elements are evenly spaced along the perimeter of the PCB.

11. The method of claim 7, wherein the plurality of antenna elements are configured to form a radiation pattern that radiates outward from the perimeter of the PCB.

12. The method of claim 7, wherein the plurality of antenna elements comprises a plurality of antenna elements packaged in a single unit.

13. A wireless node, comprising:

a transceiver;

a printed circuit board (PCB); and a plurality of antenna elements, each coupled to the transceiver and directly attached to a perimeter of the PCB via one or more solder elements, wherein the solder elements are spaced apart and electrically isolated from each other in a vicinity of the antenna elements.

14. The wireless node of claim 13, wherein the solder elements are electrically isolated from the antenna elements.

15. The wireless node of claim 13, wherein the one or more solder elements form a frame around a perimeter of the PCB.

16. The wireless node of claim 13, wherein the plurality of antenna elements comprises an array of antenna elements, and wherein the plurality of antenna elements are evenly spaced along the perimeter of the PCB.

17. The wireless node of claim 13, wherein the plurality of antenna elements are configured to form a radiation pattern that radiates outward from the perimeter of the PCB.

18. The wireless node of claim 13, wherein the plurality of antenna elements comprises a plurality of antenna elements packaged in a single unit.

19. An apparatus for wireless communications, comprising:

means for transmitting and receiving radio frequency signals; and means for directly attaching the means for transmitting and receiving radio frequency signals to a printed circuit board (PCB), wherein the means for directly attaching are spaced apart and electrically isolated from each other in a vicinity of the means for transmitting and receiving radio frequency signals.

20. The apparatus of claim 19, wherein the means for coupling are electrically isolated from the means for transmitting and receiving radio frequency signals.

21. The apparatus of claim 19, wherein the means for coupling form a frame around the perimeter of the PCB.

22. The apparatus of claim 19, wherein the means for transmitting and receiving radio frequency signals are evenly spaced along the perimeter of the PCB.

23. The apparatus of claim 19, wherein the means for transmitting and receiving radio frequency signals are configured to form a radiation pattern that radiates outward from the perimeter of the PCB.

24. The apparatus of claim 19, wherein the means for transmitting and receiving radio frequency signals comprise means for transmitting and receiving radio frequency signals packaged in a single unit.

* * * * *